US008172000B1

(12) United States Patent
Long et al.

(10) Patent No.: US 8,172,000 B1
(45) Date of Patent: May 8, 2012

(54) METHOD FOR FEEDING CONTROL LINES FOR DRILLING OR WORKOVERS

(75) Inventors: Rodney Wayne Long, Cypress, TX (US); Charles David Wintill, Houston, TX (US); William John Darnell, Houston, TX (US); William Ryle Darnell, St. Martinville, LA (US); Michael Chad Darby, Katy, TX (US)

(73) Assignee: Petroquip Energy Services, LLP, Houston, TX (US)

( * ) Notice: Subject to any disclaimer, the term of this patent is extended or adjusted under 35 U.S.C. 154(b) by 0 days.

(21) Appl. No.: 13/164,188

(22) Filed: Jun. 20, 2011

Related U.S. Application Data

(60) Provisional application No. 61/357,283, filed on Jun. 22, 2010.

(51) Int. Cl.
*E21B 19/00* (2006.01)

(52) U.S. Cl. ..... 166/385; 166/380; 166/65.1

(58) Field of Classification Search ..... 166/385, 166/380, 65.1
See application file for complete search history.

(56) References Cited

U.S. PATENT DOCUMENTS

| | | | | |
|---|---|---|---|---|
| 2003/0015324 | A1* | 1/2003 | Uhlenkott | 166/369 |
| 2004/0040722 | A1* | 3/2004 | Mosing et al. | 166/380 |
| 2006/0124318 | A1* | 6/2006 | Sheffield | 166/381 |

* cited by examiner

*Primary Examiner* — Daniel P Stephenson
*Assistant Examiner* — Yong-Suk Ro
(74) *Attorney, Agent, or Firm* — Buskop Law Group, PC; Wendy Buskop

(57) ABSTRACT

A method for feeding a downhole line between two tubulars is provided. The method can include connecting a clamping apparatus about a first tubular member. The method can include supporting a second tubular member with a support surface of the clamping apparatus, feeding a downhole line through a pass through channel formed between the clamping apparatus and a tubular member, and communicating the downhole line with a tool. The clamping apparatus can include two halves, each with support arms, connecting walls, and grips.

9 Claims, 6 Drawing Sheets

METHOD FOR FEEDING CONTROL LINES FOR DRILLING OR WORKOVERS

CROSS REFERENCE TO RELATED APPLICATIONS

The current application claims priority to and the benefit of U.S. Provisional Patent Application Ser. No. 61/357,283 filed on Jun. 22, 2010, entitled "METHOD FOR FEEDING CONTROL LINES FOR DRILLING OR WORKOVERS". This application is hereby incorporated in its entirety.

FIELD

The present embodiments generally relate to a method for feeding a downhole line between tubular members.

BACKGROUND

A need exists for feeding a downhole line between two tubular members in a safe and efficient manner.

There is a further need for feeding a downhole line that eliminates pinch points between tubular members.

The present embodiments meet these needs.

BRIEF DESCRIPTION OF THE DRAWINGS

The detailed description will be better understood in conjunction with the accompanying drawings as follows.

Figure 1:
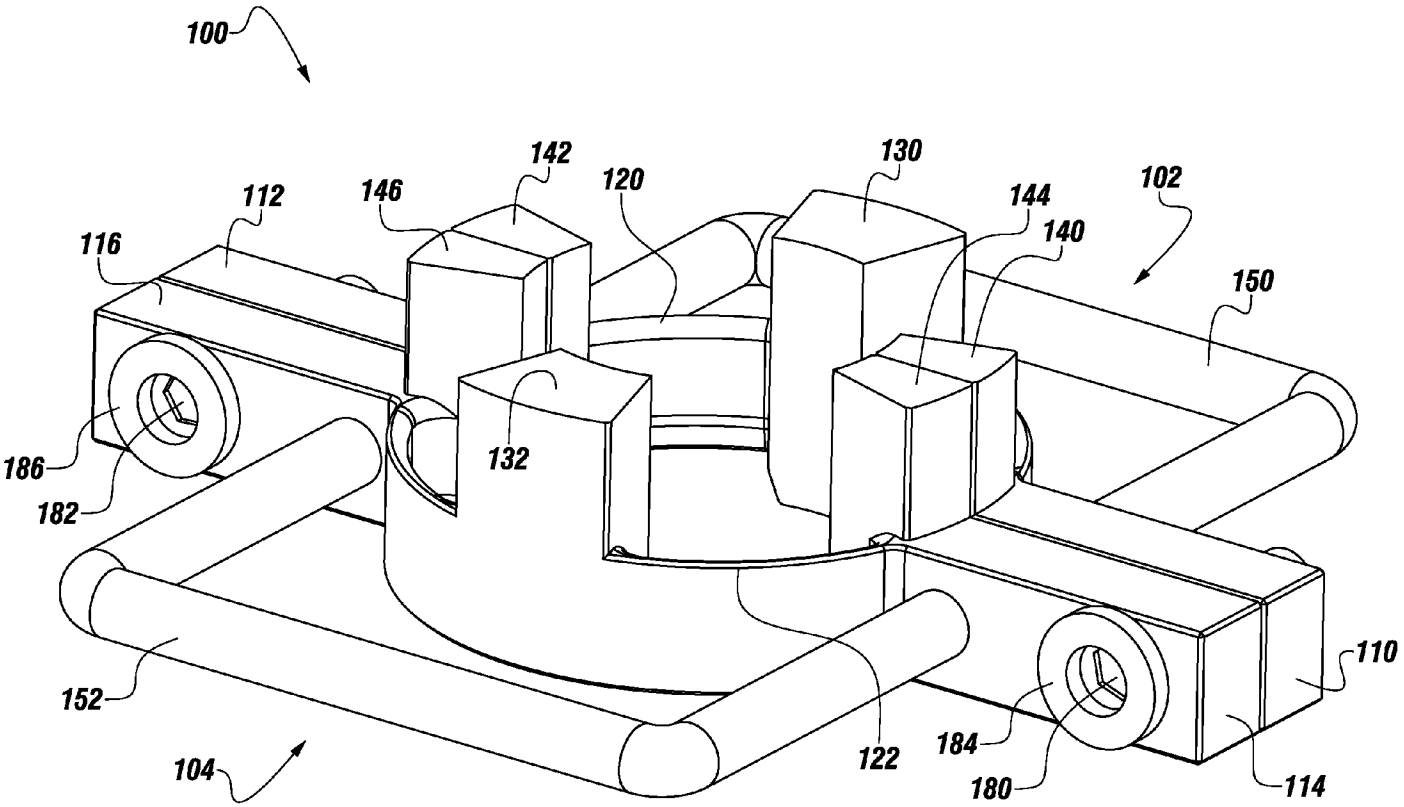
FIG. 1 is an isometric view of an embodiment of a clamping apparatus.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The present embodiments generally relate to a method for feeding a downhole line. The downhole line can be or include a hydraulic line, a signal line, a fiber optic line, a cable, a chain, a wire line, a pneumatic line, an electrical line, or other downhole lines.

One or more embodiments of the method can include connecting a clamping apparatus about a first tubular member. The clamping apparatus can include a plurality of grippers for engaging the first tubular member.

The clamping apparatus can be connected to the first tubular member by connecting a clamping apparatus first half to a clamping apparatus second half. For example, fasteners can be used to removably fasten the clamping apparatus first half to the clamping apparatus second half. In another example, a quick-release fastener can be used to secure the clamping apparatus first half with the clamping apparatus second half.

The method can include supporting a second tubular member with a clamping apparatus support surface. For example, the clamping apparatus can have one or more support arms and the second tubular member can be supported on at least a portion of one or more of the support arms.

If the second tubular member is adjacent to the first tubular member, the end or sides of one or more support arms can support the second tubular member. In another example, if the second tubular member is disposed about the first tubular member, the top of the one or more of the support arms can support the second tubular member.

The method can include feeding a downhole line through a pass through channel formed between the clamping apparatus and one of the tubular members. The pass through channel can be formed between a clamping apparatus inner surface and the first tubular member, or the pass through channel can be formed between a clamping apparatus outer surface and the second tubular member.

The method can include communicating the downhole line with a tool connected to the second tubular member, the first tubular member, or both. The tool can be a tubing hanger, a pump, a completion, or other downhole equipment or assembly.

The method can include removing the second tubular member from the clamping apparatus support surface. For example, after the downhole line is run, the second tubular member can be raised and secured by one or more set screws to a first tubular member upper portion. After the second tubular member is removed from the clamping apparatus, the clamping apparatus can be removed from the first tubular member.

In one or more embodiments of the method, the clamping apparatus first half can include a first support arm having an inner surface, and a second support arm having an inner surface. The first support arm can be attached to the second support arm by a first connecting wall having a radius of curvature. A first grip can be disposed on the first connecting wall inner surface.

The clamping apparatus can have a clamping apparatus second half selectively connectable to the clamping apparatus first half. The clamping apparatus second half can have a third support arm having an inner surface configured to abut the inner surface of the first support arm, and a fourth support arm having an inner surface configured to abut the inner surface of the second support arm.

The third support arm can be attached to the fourth support arm by a second connecting wall having the radius of curvature, and a second grip connected to an inner diameter of the second connecting wall. The support arms can be used to support the outer tubular member.

Turning now to the Figures, FIG. 1 is an isometric view of a clamping apparatus according to one or more embodiments. The clamping apparatus 100 can include a clamping apparatus first half 102 and a clamping apparatus second half 104. The clamping apparatus 100 can have one or more support arms (four are shown 110, 112, 114, and 116), one or more connecting walls (two are shown 120 and 122), one or more grips (two are shown 130 and 132), one or more support arm grips (four are shown 140, 142, 144, and 146), and one or more handles (two are shown 150 and 152).

The clamping apparatus first half 102 can include a first support arm 110 connected to a second support arm 112 by a first connecting wall 120. A first support arm grip 140 can be disposed on the first support arm 110. A second support arm grip 142 can be disposed on the second support arm 112.

The first support arm grip 140 can be welded, bolted, or otherwise connected to the first support arm 110 adjacent to the first connecting wall 120. The second support arm grip 142 can be connected to the second support arm 112 adjacent to the first connecting wall 120.

The clamping apparatus second half 104 can have a fourth support arm 116 connected to a third support arm 114 by a second connecting wall 122. A third support arm grip 144 can be disposed on the third support arm 114. A fourth support arm grip 146 can be disposed on the fourth support arm 116.

The third support arm grip 144 can be welded, bolted, or otherwise connected to the third support arm 114 adjacent to the second connecting wall 122. The fourth support arm grip 146 can be connected to the fourth support arm 116 adjacent to the second connecting wall 122.

The connecting walls 120 and 122 can have a radius of curvature. The radius of curvature can be such that each connecting wall can fit about a portion of a downhole tubular.

An inner surface of the first support arm 110 can mate with an inner surface of the third support 114, and an inner surface of the second support arm 112 can mate with a an inner surface of the fourth support arm 116. When the support arms 110, 112, 114, and 116 are mated with one another, the connecting walls 120 and 122, and the ends of the support arms 110, 112, 114, and 116 adjacent to the connecting walls 120 and 122 can form a substantially circular surface.

The clamping apparatus first half 102 and the clamping apparatus second half 104 can be secured to one another by one or more threaded fasteners (two are shown 180 and 182). A first threaded fastener 180 can attach the first support arm 110 and the third support arm 114 to one another. A second threaded fastener 182 can attach the second support arm 112 and the fourth support arm 116 to one another.

One or more fastener retainers (two are shown 184 and 186) can be used to keep the fasteners 180 and 182 from falling from the support arms when the clamping apparatus first half 102 and the clamping apparatus second half 104 are not secured together.

A first fastener retainer 184 can be used to keep the first threaded fastener 180 with the third support arm 114, and a second fastener retainer 186 can be used to keep the second threaded fastener 182 with the fourth support arm 116. Each fastener retainer 184 and 186 can be a washer, a cage, or another retaining device that allows access to the threaded fasteners but prevents the threaded fasteners from falling from the associated support arm.

A first handle 150 can be connected to the first support arm 110 and the second support arm 112. In addition, the clamping apparatus first half 102 can include a first grip 130 connected to an inner surface of the first connecting wall 120. A second handle 152 can be connected to the third support arm 114 and the fourth support arm 116. In addition, the clamping apparatus second half 104 can have a second grip 132 connected to an inner surface of the second connecting wall 122.

Figure 2:
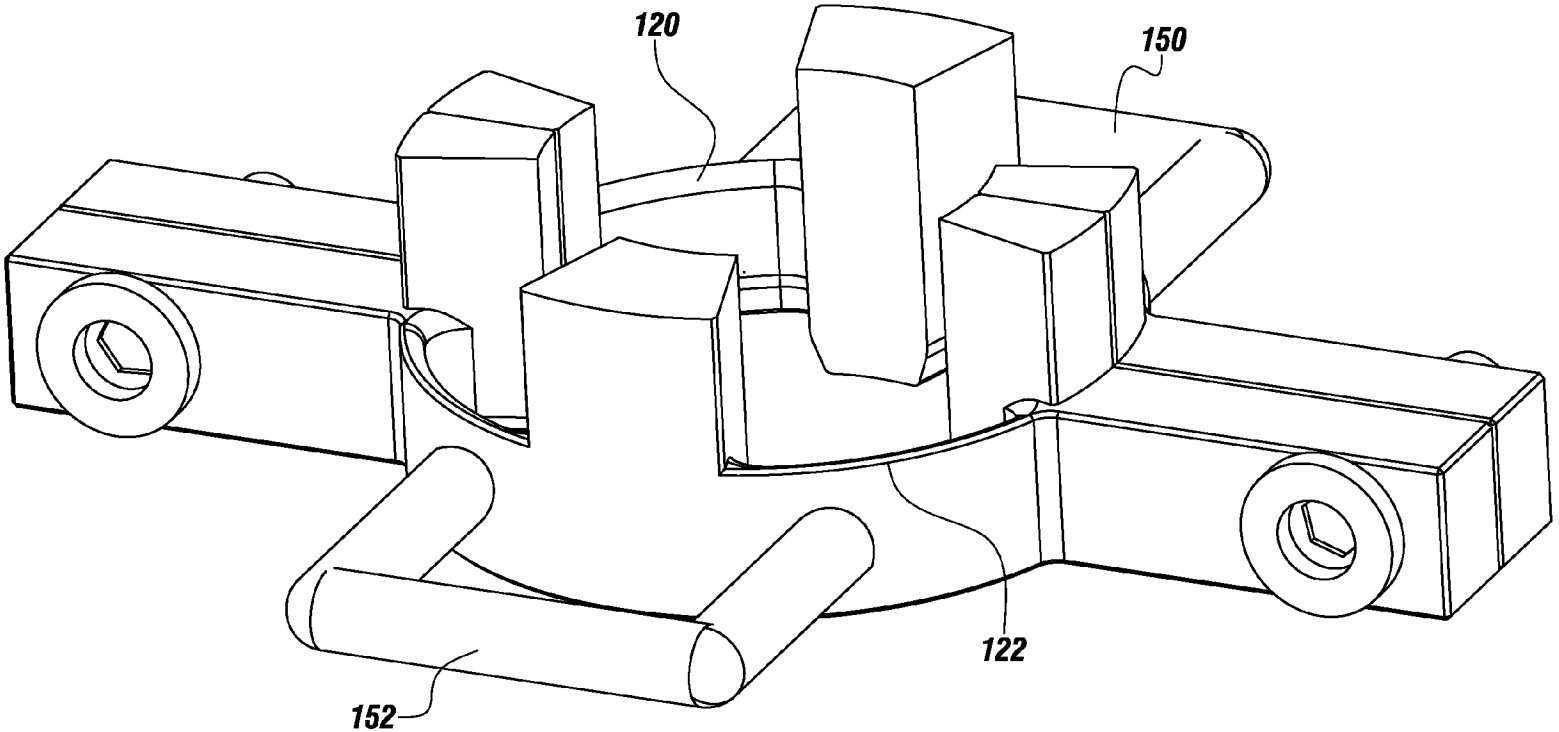
FIG. 2 depicts an isometric view of an embodiment of the clamping apparatus.

In one or more embodiments, such as depicted in FIG. 2, the second handle 152 can be connected to the second connecting wall 122 and the first handle 150 can be connected to the first connecting wall 120.

Figure 3:
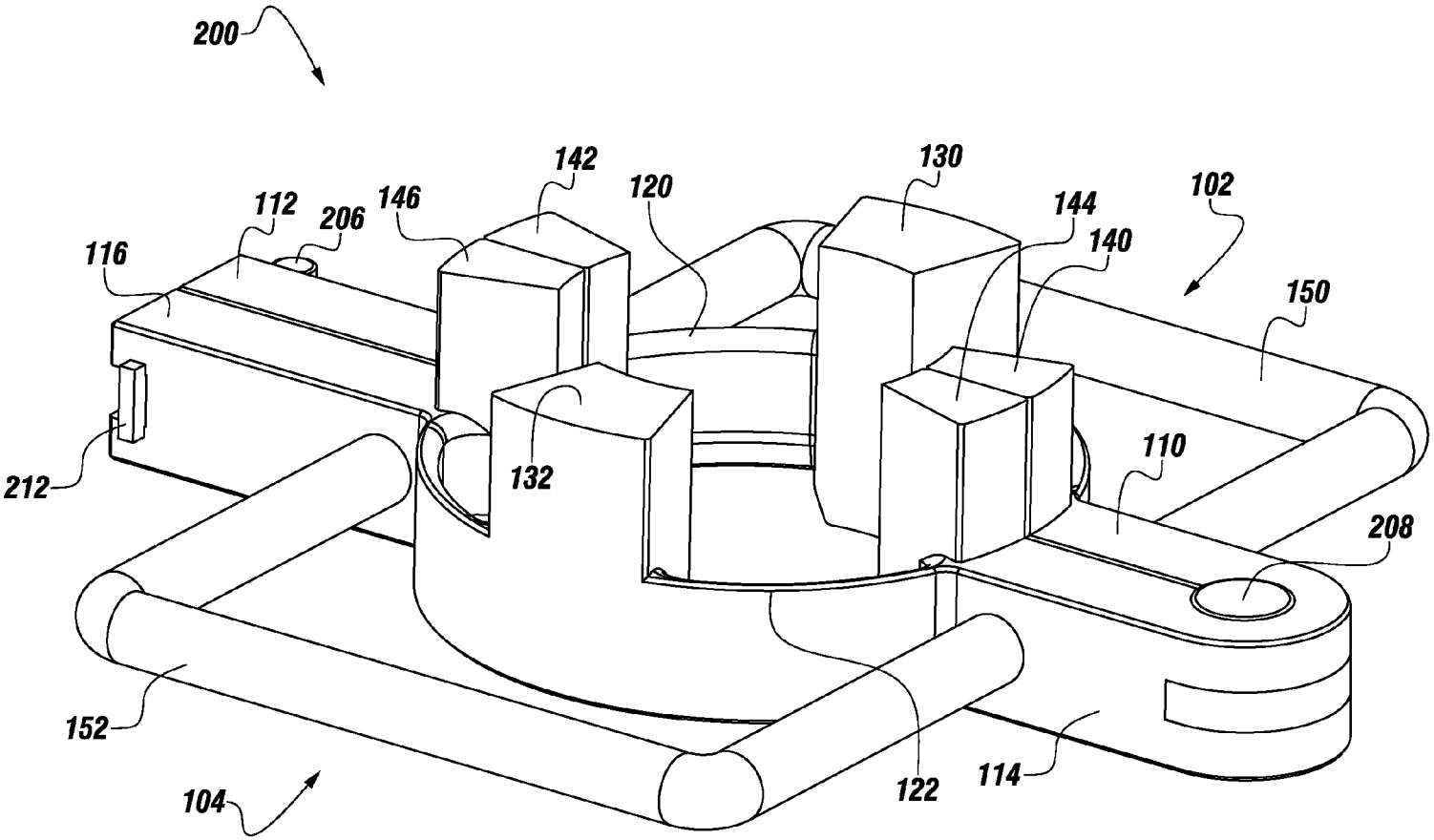
FIG. 3 depicts an isometric view of another embodiment of the clamping apparatus.

FIG. 3 depicts an isometric view of another illustrative embodiment of a clamping apparatus. The clamping apparatus 200 can be substantially similar to clamping apparatus 100, shown in FIG. 1. However, a portion of the clamping apparatus first half 102 can be hinged to a portion of the clamping apparatus second half 104.

A latch 206 can be used to selectively secure a portion of the clamping apparatus first half 102 to a portion of the clamping apparatus second half 104. One or more hinges 208 can connect the first support arm 110 to the third support arm 114.

The latch 206 can be disposed on the second support arm 112, and a latch receptacle 212 can be disposed on the fourth support arm 116. The placement of the latch receptacle 212 onto the fourth support arm 116 can be done by forming the latch receptacle 212 into the fourth support arm 116, welding the latch receptacle 212 to the fourth support arm 116, or otherwise placing the latch receptacle 212 on the fourth support arm 116.

FIG. 3 also shows the connecting walls 120 and 122, the handles 150 and 152, the grips 130 and 132, and the support arm grips 140, 142, 144, and 146, which can be substantially similar to FIG. 1.

Figure 4:
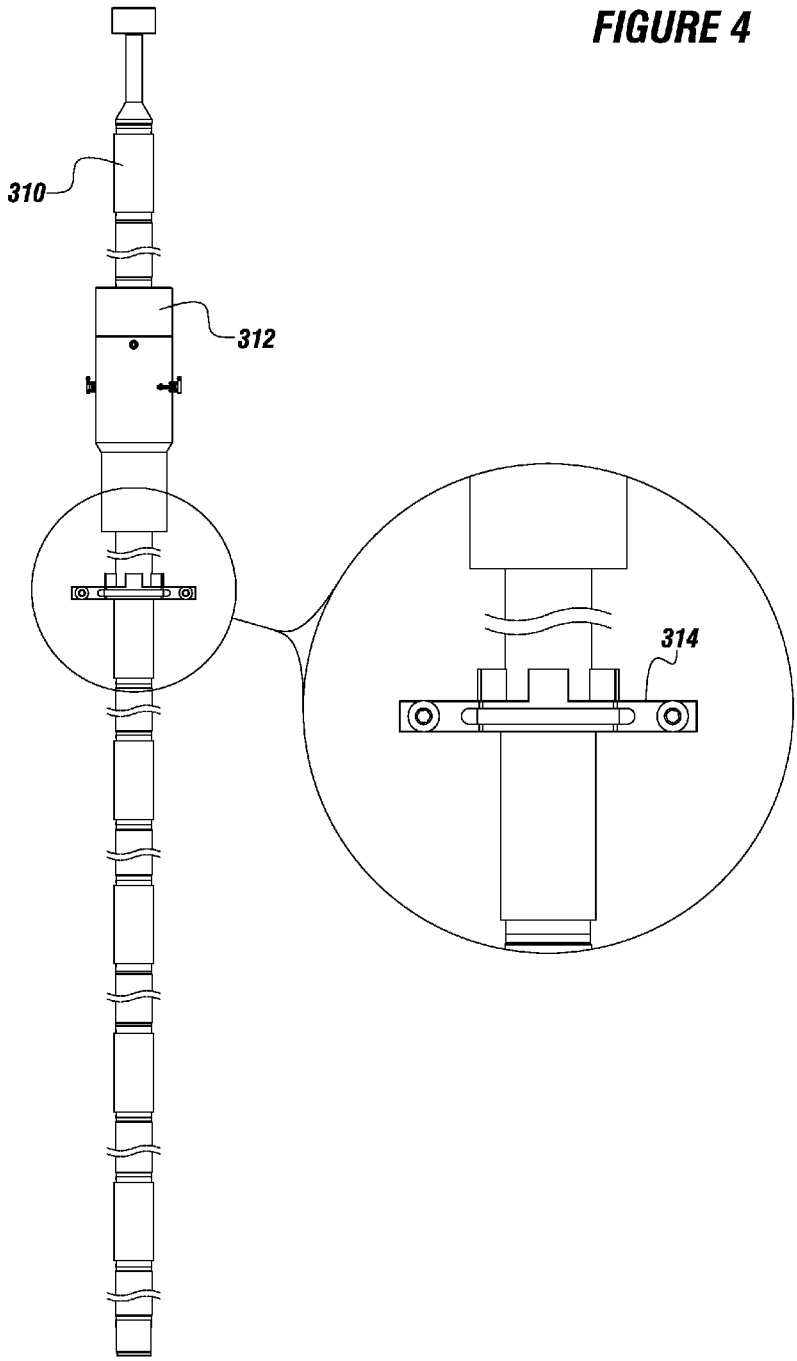
FIG. 4 depicts a schematic of a system for feeding a downhole line between two tubular members with an outer tubular member in a raised position.

FIG. 4 depicts a schematic of a system for feeding a downhole line between two tubular members with the outer tubular member in a raised position. The system can include an inner tubular member 310 and an outer tubular member 312. The outer tubular member 312 can be disposed about the inner tubular member 310. The inner tubular member 310 can be a completion string or another downhole tubular. The outer tubular member 312 can be a shroud, a housing, a perforated tubing, or another downhole tubular member. A clamping apparatus 314 can be disposed about the inner tubular member 310. The clamping apparatus 314 can be substantially similar or the same as any of the clamping apparatus described herein.

Figure 5:
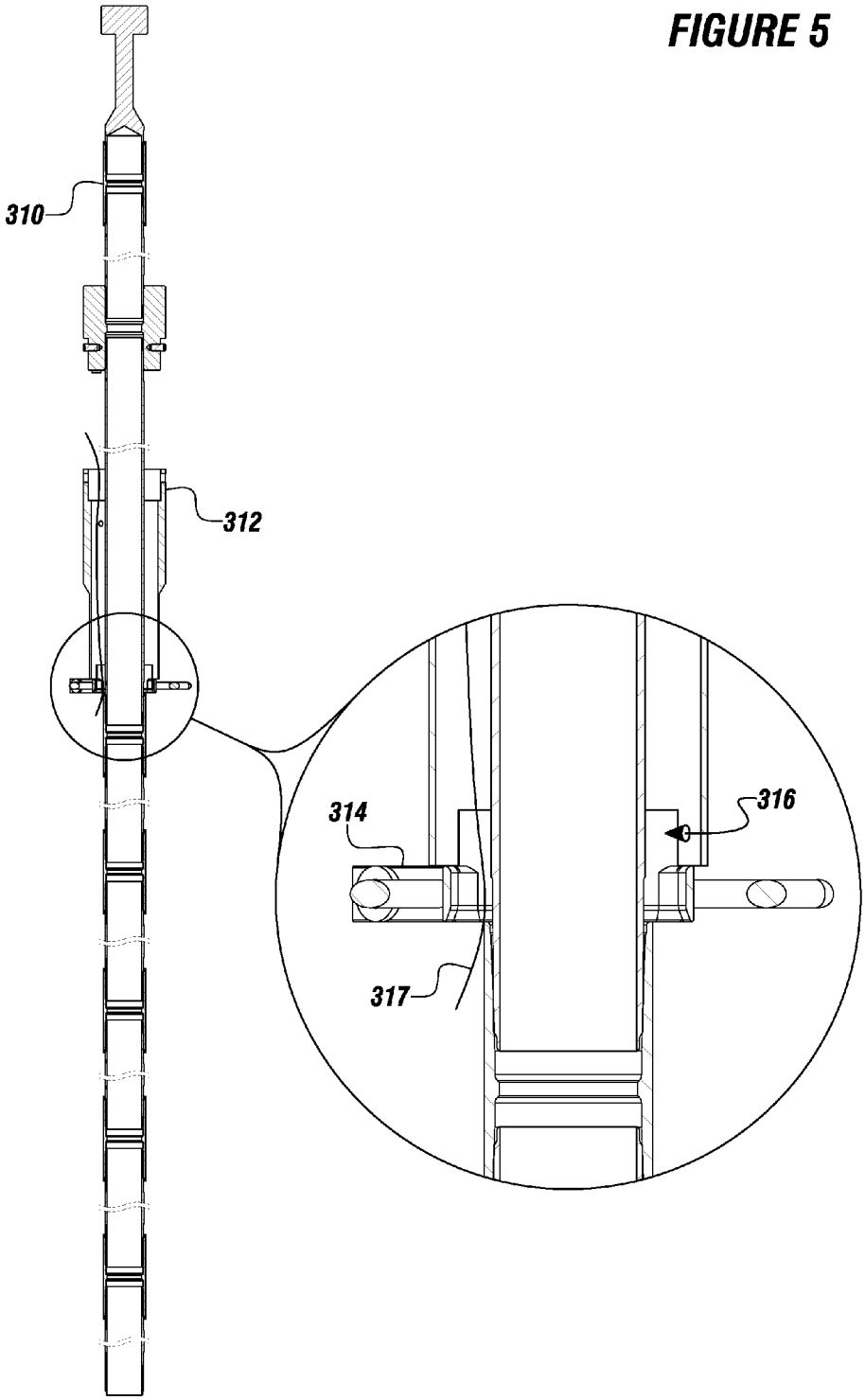
FIG. 5 depicts a schematic of the system wherein the outer tubular member is in a resting position and a downhole line is being fed through an inner tubular member and the outer tubular member.

FIG. 5 depicts a schematic of the system of FIG. 4, wherein the outer tubular member 312 is in a resting position and a downhole line 317 is being fed between the inner tubular member 310 and the outer tubular member 312. The outer tubular member 312 can be lowered onto the clamping apparatus 314. The clamping apparatus 314 can support the outer tubular member 312. In addition, one or more channels 316 can be formed between the inner tubular member 310 and the inner diameter of the clamping apparatus 314.

The downhole line 317 can be fed between the clamping apparatus 314 and the inner tubular member 310 through the channel 316. The downhole line 317 can be connected to or placed in communication with one or more downhole tools (not shown). The downhole tool can be a tubing hanger, a sliding sleeve, a sensor, a pump, or another downhole equipment.

Figure 6:
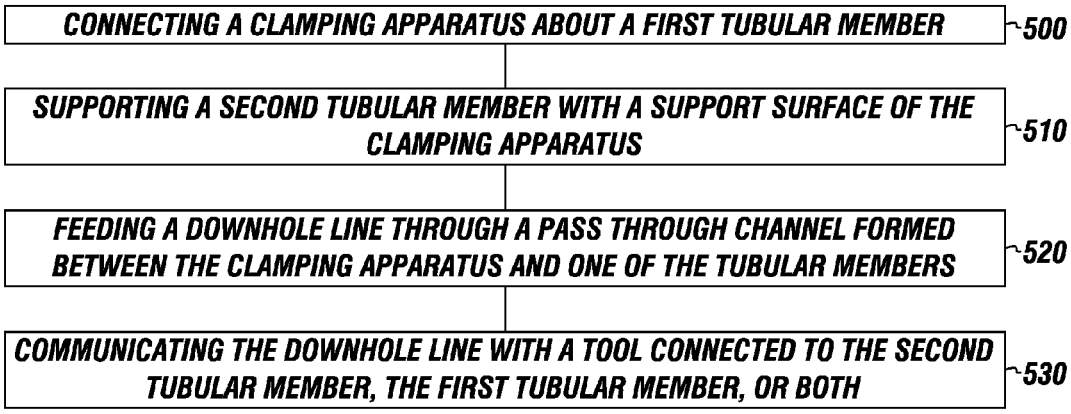
FIG. 6 depicts a flow diagram of a method for using the clamping apparatus to feed a downhole line between two tubular members according to one or more embodiments.

FIG. 6 depicts a flow diagram of a method for using the clamping apparatus to feed downhole lines between two tubular members according to one or more embodiments.

The method for feeding downhole lines between two tubulars can include connecting a clamping apparatus about a first tubular member, as depicted at box 500.

At box 510, the method can include supporting a second tubular member with a support surface of the clamping apparatus.

The method can include feeding a downhole line through a pass through channel formed between the clamping apparatus and one of the tubular members, which is depicted at box 520.

In addition, the method can include communicating the downhole line with a tool connected to the second tubular member, the first tubular member, or both, as depicted in box 530.

While these embodiments have been described with emphasis on the embodiments, it should be understood that within the scope of the appended claims, the embodiments might be practiced other than as specifically described herein.

What is claimed is:

1. A method for feeding a downhole line between two tubulars, the method comprising:

a. connecting a clamping apparatus about an inner tubular member, wherein the clamping apparatus comprises:

(i) a clamping apparatus first half comprising:

(a) a first support arm having an inner surface;

(b) a second support arm having an inner surface, wherein the first support arm is attached to the second support arm by a first connecting wall having a radius of curvature; and (c) a first grip disposed on a first connecting wall inner surface; and (ii) a clamping apparatus second half selectively connectable to the clamping apparatus first half, wherein the clamping apparatus second half comprises:

(a) a third support arm having an inner surface configured to abut the first support inner surface;

(b) a fourth support arm having an inner surface configured to abut the second support arm inner surface, wherein the third support arm is attached to the fourth support arm by a second connecting wall having a radius of curvature; and (c) a second grip connected to an inner diameter of the second connecting wall;

b. supporting an outer tubular member with at least a portion of the support arms of the clamping apparatus;

c. feeding a downhole line through a pass through channel formed between the inner surface of the connecting walls and the inner tubular member; and d. communicating the downhole line with a tool connected to the outer tubular member, the inner tubular member, or both.

2. The method of claim 1, wherein connecting the clamping apparatus about the inner tubular member comprises connecting the clamping apparatus first half to the clamping apparatus second half.

3. The method of claim 2, further comprising using fasteners to removably fasten the clamping apparatus first half to the clamping apparatus second half.

4. The method of claim 2, further comprising using a quick-release fastener to engage the clamping apparatus first half with the clamping apparatus second half.

5. The method of claim 1, further comprising removing the outer tubular from the support arms of the clamping apparatus.

6. The method of 1, wherein the tool is a tubing hanger.

7. The method of claim 1, further comprising removing the clamping apparatus from the inner tubular member.

8. The method of claim 1, wherein the grips and support arms engage an outer diameter of the inner tubular member.

9. The method of claim 1, wherein the downhole line is a hydraulic line, a fiber optic line, a signal line, a chain, a cable, a pneumatic line, an electrical line, or the like.

* * * * *